United States Patent [19]

Mourao et al.

[11] Patent Number: 4,522,631

[45] Date of Patent: Jun. 11, 1985

[54] DIESEL FUEL CONTAINING RARE EARTH METAL AND OXYGENATED COMPOUNDS

[75] Inventors: Antonio M. Mourao, Wappingers Falls; Clifford H. Faist, Monsey, both of N.Y.

[73] Assignee: Texaco Inc., White Plains, N.Y.

[21] Appl. No.: 553,019

[22] Filed: Nov. 18, 1983

[51] Int. Cl.[3] ..... C10L 1/08

[52] U.S. Cl. ..... 44/57; 44/56; 44/68

[58] Field of Search ..... 44/56, 57, 68

[56] References Cited

U.S. PATENT DOCUMENTS

| | | | |
|---|---|---|---|
| 2,128,685 | 8/1938 | Yates | 44/56 |
| 2,221,839 | 11/1940 | Lipkin | 44/56 |
| 2,737,932 | 3/1956 | Thomas | 44/68 UX |
| 2,774,656 | 12/1956 | Newman et al. | 44/57 |
| 3,976,437 | 8/1976 | Shang et al. | 44/56 |
| 4,207,078 | 6/1980 | Sweeney et al. | 44/56 |
| 4,251,233 | 2/1981 | Sievers et al. | 44/68 |
| 4,264,335 | 4/1981 | Bello et al. | 44/68 |

*Primary Examiner*—Y. Harris-Smith

*Attorney, Agent, or Firm*—Robert A. Kulason; James F. Young; James J. O'Loughlin

[57] ABSTRACT

Addition of an oxygenated compound and a diesel fuel soluble form of a rare earth metal has been found to reduce particulate emissions from a diesel fueled engine. Preferred soluble rare earth metal additives include cerium carbonyls such as cerium salts of alkylcarboxylic acids and cyclic carboxylic acids.

6 Claims, No Drawings

DIESEL FUEL CONTAINING RARE EARTH METAL AND OXYGENATED COMPOUNDS

BACKGROUND OF THE INVENTION

This invention relates to a process of reducing exhaust emissions of diesel fueled internal combustion engines, and more particularly to the use of rare earth metal compounds to reduce the amount of particulates in diesel engine exhaust emissions.

Diesel fueled internal combustion engines give off particulates in the exhaust which may be harmful pollutents. These particulates are both particules seen as visible smoke and also are those particles which are invisible but still present in the diesel exhaust. The Federal Environmental Protection Agency has recently determined that diesel powered automobiles emit unacceptably high levels of air pollution and the levels of particulate emissions must be reduced to about 0.2 gram per mile by 1985. Presently most diesel engines used in automobiles will probably exceed this limit.

Various additives have been suggested for use in diesel fuels to reduce particulate emissions. U.S. Pat. Nos. 2,926,454; 3,410,670; 3,413,102; 3,539,312 and 3,499,742 are representative patents which show smoke suppressants which are commonly employed in or added to the diesel fuel oils. In general, the previously used most common smoke suppressants employed an organic compound of barium. Calcium compounds have also been proposed to replace the barium materials previously suggested because of the possibility of the toxicity of the barium.

Coassigned U.S. Pat. No. 4,207,078 sets forth a reduction in soot and visible particulate matters from the exhaust of diesel fueled engines by incorporating within the diesel fuel an additive consisting of a mixture of an oxygenated compound and an alkyl cyclopentadienyl manganese tricarbonyl.

Coassigned U.S. Pat. No. 4,222,746 sets forth the addition of wax oxidates to diesel fuel along with a fuel soluble organometallic compound such as alkyl cyclopentadienyl manganese tricarbonyl complex salts. The combined effect of these two additives reduces the soot and visible particulates emitted from the exhaust of diesel fueled internal combustion engines.

SUMMARY OF THE INVENTION

It is now been found that the addition of a diesel fuel soluble compound of a rare earth metal, preferably cerium and an oxygenated compound to a diesel fuel reduces the grams per mile of particulates produced by a diesel engine using this fuel, as defined by the EPA, to a much larger degree than the reduction in particulates which occurs by the addition of an equal amount of either of the two additives alone. The synergistic effect of the two additives dramatically reduces particulate emissions in diesel fueled internal combustion engines.

PREFERRED EMBODIMENTS OF THE INVENTION

In accordance with the invention, a diesel fuel is modified by mixing therewith an oxygenated compound and a diesel fuel soluble compound of a rear earth metal, preferable cerium. Rare earth metals include: lanthanum, cerium, praseodymium, neodymium, promethium, samarium, europium, gadollnium, terbium, dysprosium, holmium, erbium, thulium, ytterbium and lutetium. Suitable oxygenated compounds include alkylcarbitols having from about 5 to about 16 carbon atoms such as n-hexylcarbitol, aldehydes and ketones having from about 3 to 16 carbon atoms such as propionaldehyde, acetone, normal alcohols having from about 3 to 16 carbon atoms, and various cyclic and normal ethers having from about 2 to about 16 carbon atoms. In general, enough of the oxygenated compound should be added to the diesel fuel to provide from about 0.0025 to about 1.5 weight percent, and preferably from about 0.0025 to about 1% by weight of the oxygen in the diesel fuel. Presently the most preferred oxygenated compound is a carbitol which is a monoalkyl ether of diethylene glycol. The presently most preferred carbitol is n-hexylcarbitol.

The rare earth metal compound is preferably an oxygen containing diesel fuel soluble form of the rare earh metal. The metal compound can contain from about 3 to 25 carbon atoms, even though larger numbers of carbon atoms are also useful. Preferred compounds of the rare earth are organometallic compounds containing oxygen. The quantity of the rare earth metal present in the diesel fuel can vary from about 0.001 to about 0.10 percent by weight of the diesel fuel. Preferably the quantity of the rare earth metal varies from about 0.001 to about 0.05 percent by weight of rare earth metal in the diesel fuel. The presently most preferred form of the diesel fuel soluble rare earth metal comprises a carbonyl. Suitable rare earth metal carbonyls include rare earth metal salts of alkyl carboylic acids, and of cycloalkyl carboxylic acids. A preferred rare earth metal additive comprises a rear earth octoate which has the following formula:

$$C_7H_{15}-\overset{\overset{\displaystyle O}{\|}}{C}-O-M$$

where M stands for the rare earth metal. Presently the most preferred rare earth metal is cerium.

The invention also comprises a fuel additive concentrate which includes a major amount of a diesel fuel soluble form of a rare earth metal, preferably cerium, a diesel soluble oxygenated compound and a minor amount of a diesel fuel composition boiling in the range of about 350° F. (175° C.) to 750° F. (400° C.). This fuel concentrate can be added to a diesel fuel composition boiling in the range of about 350° F. (175° C.) to 750° F. (400° C.) to reduce the particulate emission properties of the diesel fuel. Preferably the fuel concentrate contains from about 1% to 50% by weight of the rare earth metal compound, whose composition is given in the previous paragraphs. Further the fuel concentrate preferably contains from about 10% to about 80% by weight of the oxygenated compound whose composition is given above.

Whenever the expression "diesel fuel" is employed in the description and claims, it is to be understood that this term designates the hydrocarbon fraction which distills after kerosine. Its property requirements are those given on pages 11–37 of the "Petroleum Process Handbook", 1967 edition. Generally, the diesel fuel will comprise a mixture of hydrocarbons boiling in the range from about 350° to about 700° F.

The following examples are set forth as illustrative of the present invention and are not meant to limited it in any way.

EXAMPLE I (COMPARATIVE)

In order to measure the particulate emissions of a representative diesel fuel mixture, a base fuel was used which was similar to that sold for use in passenger car diesel engines. The base fuel was used to operative a 1980 Oldsmobile containing a 5.7 liter diesel engine which was equipped with a EGR system. The vehicle was operated through two driving cycles on a chassis dynamometer. In the first cycle, the vehicle was operated for a time to warm up and then driven through a series of accelerations interspersed with idle periods. This cycle encompassed about 3.6 miles of driving in about 500 seconds. The highest vehicle speed in this cycle was about 57 miles per hours. In the second cycle, the vehicle covered about 4 miles during about 900 seconds of operation, vehicle speed during this phase was rarely above 30 miles per hour. A small percentage of the total exhaust gases produced during the run was withdrawn and passed through a fiber glass filter disc. The filter was then weighed and the weight of the particulates was recorded. This test closely follows the federal test procedure, hot start.

The base fuel produced about 0.347 gram per mile of particulates. When about 2% by weight of n-hexylcarbitol was added to the base fuel and the two driving cycles repeated, the particulate emissions rose to about 0.376 gram per mile which was an increase of about 8%.

EXAMPLE II

A second emission test was conducted on the same base fuel as was used as in Example I, in the same 1980 Oldsmobile. Particulate emissions during this run was about 0.424 gram per mile.

When about 0.083% by weight of cerium octoate which contained about 12% by weight cerium was added to the base fuel, the particulate emissions during the same test dropped to about 0.372 gram per mile which was a decrease of about 12%.

When 0.083% by weight of the cerium octoate and about 2% by weight of the n-hexylcarbitol were added to the base fuel, the particulate emissions dropped to about 0.329 gram per mile which was a 22% decrease in particulate emissions as compared to the base fuel containing no additives designed to reduce particulate emissions. Such a large decrease in particulate emissions shows a synergistic effect of the cerium octoate and n-hexylcarbitol in the reduction of particulate emissions. This is surprising since the n-hexylcarbitol increased particulate emissions by 8% and the cerium octoate alone only decreased particulate emissions by 12%.

EXAMPLE III

A base diesel fuel similar to that of Example I was tested for particulate emissions as in Example I. The particulate emissions was about 0.385 gram per mile. When about 0.083 weight percent of cerium octotate and about 0.1 percent by weight n-hexylcarbitol were added to the base fuel, particulate emissions dropped to about 0.330 gram per mile, which was a decrease of about 14%. This shows that larger quantities of the oxygen containing compound improve the results obtained by the mixture of additives which is surprising in view of Example I, where it was shown that an oxygenated compound alone raises the particulate emissions.

The above examples are for illustrative purposes only and one skilled in the art can effect variations and modifications to the above without going outside the scope of the present invention as set forth in the following claims.

What is claimed is:

1. A diesel fuel comprising a hydrocarbon based diesel fuel composition boiling in the range of about 350° F. (175° C.) to 750° F. (400° C.) and containing a particulate suppressing mixture of between about 0.001 and about 0.1% by weight of a cerium salt of an acid selected from the group consisting of carboxylic acids and cycloalkyl carboxylic acids having from 3 to 25 carbon atoms, and an alkylcarbitol having from about 5 to 16 carbon atoms providing from about 0.0025 to 1.5 wt. % of oxygen in said diesel fuel.

2. The fuel of claim 1, wherein said rare earth metal compound comprises cerium octoate.

3. The fuel of claim 1, wherein said carbitol comprises n-hexylcarbitol.

4. The fuel composition of claim 1, wherein said cerium is present in the amount between 0.001 and about 0.05% by weight of said fuel and said alkyl carbitol provides from about 0.0025 to about 1% by weight of oxygen in said diesel fuel.

5. The fuel of claim 4 wherein said cerium carbonyl comprises cerium octate and said alkyl carbitol comprises n-hexyl carbitol.

6. A fuel additive concentrate comprising a major amount of a cerium salt of an acid selected from the group consisting of carboxylic acids and cycloalkyl carboxylic acids having from 3 to 25 carbon atoms, an alkyl carbitol having from about 5 to 16 carbon atoms and a minor amount of a diesel fuel composition boiling in the range of about 350° F. (175° C.) to 750° F. (400° C.).

* * * * *